United States Patent [19]

Faltynek

[11] Patent Number: 4,993,845

[45] Date of Patent: Feb. 19, 1991

[54] COUPON POCKET BAG

[76] Inventor: Mark Faltynek, 3424 W. 82nd St., Chicago, Ill. 60652

[21] Appl. No.: 464,373

[22] Filed: Jan. 12, 1990

[51] Int. Cl.[5] ..... B65D 30/22

[52] U.S. Cl. ..... 383/40; 383/111; 229/70; 206/542; 206/831

[58] Field of Search ..... 383/40, 106, 111, 127; 229/70; 206/831, 610, 541, 542, 548, 459

[56] References Cited

U.S. PATENT DOCUMENTS

| | | | |
|---|---|---|---|
| 2,614,349 | 10/1952 | Barnes | 383/111 X |
| 2,867,372 | 1/1959 | Fox | 383/40 X |
| 2,931,557 | 4/1960 | Loderhouse | 206/831 X |
| 2,986,325 | 5/1961 | Loderhouse | 206/459 X |
| 3,804,323 | 4/1974 | Bemel | 383/40 |
| 4,345,393 | 8/1982 | Price et al. | 206/831 X |
| 4,485,926 | 12/1984 | Lenzmeier | 206/831 X |
| 4,545,781 | 10/1985 | Carl et al. | 206/831 X |

FOREIGN PATENT DOCUMENTS

| | | | |
|---|---|---|---|
| 6398 | 4/1899 | United Kingdom | 383/106 |
| 709750 | 6/1954 | United Kingdom | 383/111 |
| 2074541 | 11/1981 | United Kingdom | 383/127 |

*Primary Examiner*—Stephen Marcus
*Assistant Examiner*—Jes F. Pascua
*Attorney, Agent, or Firm*—Hill, Van Santen, Steadman & Simpson

[57] ABSTRACT

There is provided herein a bag construction of multi-ply construction wherein a pair of inner and outer plies form a front panel, a back panel, and a pair of side panels each joined to the front and back panels, and bottom panel joined to each of the front, back and side panels. An open top provides for access to the interior of the bag and access to a primary compartment. The improvement comprises only the outer ply of the front panel being die cut along a first edge and perforated along the second, third and fourth edges so as to form a secondary pocket for insertion of the items into the bag and so that a coupon-like section can be removed along the die cut and perforations so as to form an integral but removable coupon-like section. In another embodiment the coupon-like section includes a plurality of smaller removable sections separated by perforation lines.

2 Claims, 1 Drawing Sheet

COUPON POCKET BAG

BACKGROUND OF THE INVENTION

This invention relates to paper bags of the type used to carry consumer products, usually fast food items, and more particularly, a bag which is constructed to form a primary pocket and an auxiliary or second pocket which includes integral coupon indicia, which pocket is useful in carrying a second or promotional item in addition to the principal item.

Paper bags of the type used to carry consumer goods are well known. These bags are commonly used in markets to carry grocery items and in the retail fast food trade. These bags are fabricated from a single sheet of paper or a lamination of sheets of paper or plies which have been bonded together, glued to form a tube, and then severed and folded. The bags thus formed define front, back, side and bottom panels or walls. Such bags have an open top and define a primary product carrying compartment or pocket into which items, such as grocery items or fast food items, are loaded. The outer surface of the bag can be printed with various types of indicia. Moreover, if two plies are used, the inner and outer plies can have the same or different properties. For example, the inner ply can be liquid or grease resistant and the outer ply may be strong and susceptible to printing thereon. Various combinations of the properties can be selected depending upon the use the bag is to be put.

Usually, bags have only a primary load-carrying compartment for carrying a single type of item unless all purchased items are to be carried together. It is sometimes desirable also to carry other items such as eating utensils such as knives, forks and spoons, napkins, and the like, and preferably apart from the main compartment.

In addition, it is desirable to print integrally but removably such bags with indicia which can be used as a coupon later on. U.S. patent applications Ser. No. 390,823 filed Aug. 8, 1989 and Ser. No. 390,826 filed Aug. 8, 1989, as well as U.S. Pat. Nos. 139,718; 1,975,404; 2,047,745; 2,330,051; 2,344,369; 2,867,372; 2,917,164; 3,522,908; 3,762,628; 4,204,600; German No. 859559; German No. DE 3716556A; and French No. 2435401 disclose various types of compartmented bags.

In this system it is an object to provide a bag having an open primary compartment, an open secondary compartment, and a coupon indicia section integrally and removably associated with the secondary compartment.

These and other objects of this invention will become apparent from the following disclosure and appended claims.

SUMMARY OF THE INVENTION

There is provided by this invention a bag which forms two separate compartments, a primary compartment for the primary items, and a secondary compartment for eating utensils and similar articles. Moreover, a secondary compartment-forming ply and front panel ply also provide a coupon function in that coupon-like indicia can be provided thereon for separation from the bag after use.

The bag is formed using a multi-ply construction formation (sometimes referred to as a bag in a bag) with the outer ply slit adjacent the top or open edge of the bag so as to provide a secondary compartment in the front wall of the bag between the inner ply and outer ply of the bag. The front ply is die cut to form the pockets' top edge so as to provide the open top for the secondary compartment and perforated along the remaining three edges so as to permit separation of the coupon section of the bag. In this manner primary fast food items can be placed in the primary section of the bag and eating utensils, condiments, and the like can be carried in the secondary compartment of the bag which is formed between the inner and outer plies of the bag. The front ply that forms the secondary compartment can then be removed and used as a coupon.

DESCRIPTION OF THE PREFERRED EMBODIMENT

Figure 1:
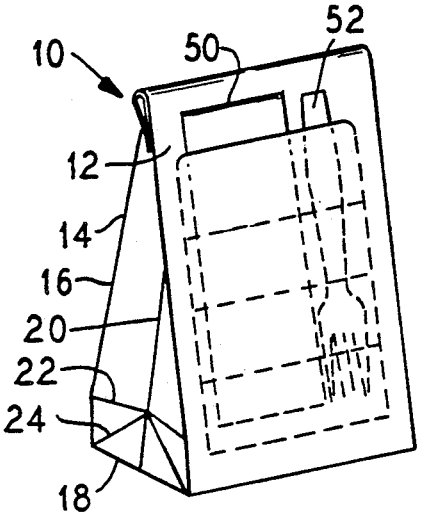
FIG. 1 is a perspective view showing a bag having a primary compartment, a secondary compartment, and a coupon indicia on the front panel.
Figure 2:
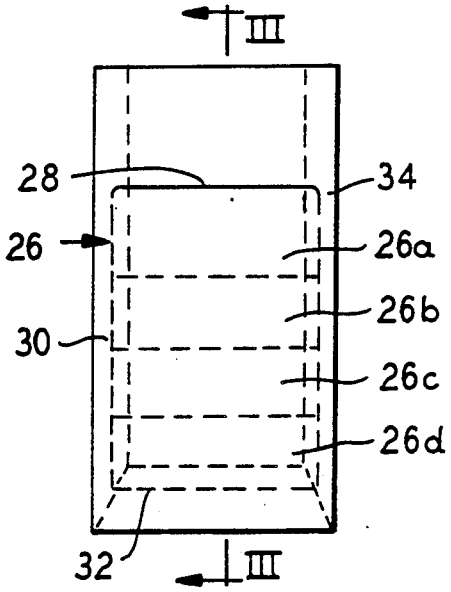
FIG. 2 is a front elevational view showing the front portion of the bag with the outer ply, secondary compartment, and coupon section.

Referring first to FIG. 1, there is shown a bag 10 generally which includes a front panel 12, a rear panel 14, and a pair of side panels such as 16, and a bottom panel such as 18. The panels are folded together in the known manner along gusset lines such as 20, 22 and 24.

The front panel of the bag 12 includes a coupon section 26 generally, that has been divided into four perforated coupon subsections **26*a*, 26*b*, 26*c*, and 26*d*. The coupon section is defined by a die cut line 28 that extends through the outer ply of the two-ply system that forms the outer panel at the top edge of the coupon section. The remaining lines 30, 32 and 34** are perforated to permit ease of removal of the section.

Figure 3:
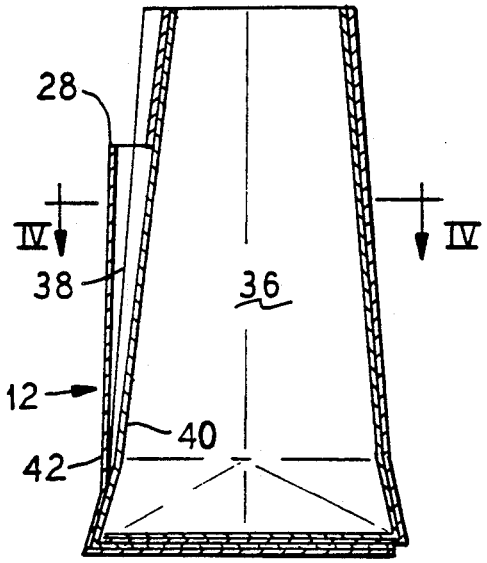
FIG. 3 is a sectional view taken substantially along line III—III of FIG. 2 showing a bag having an open top and defining the primary and secondary compartments.
Figure 4:
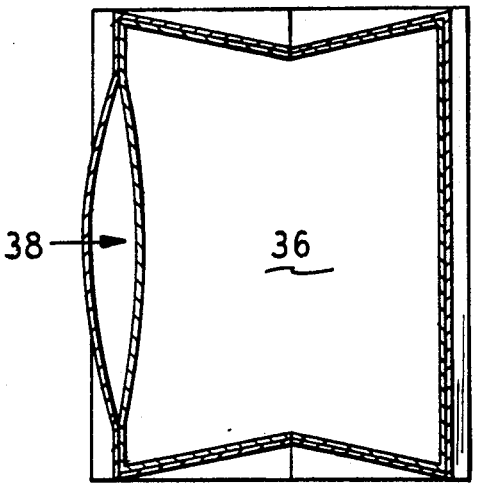
FIG. 4 is a horizontal sectional view taken substantially along a line such as IV—IV in FIG. 3 showing the bag interior with the primary and secondary compartments.

The pockets can best be seen in FIG. 3 where the primary pocket is identified as 36 generally, and the secondary pocket as 38 generally. It can be seen from the view of FIG. 3 that the bag, particularly the front panel 12, is made up of the inner ply 40 and outer ply 42. Moreover, the outer ply 42 has been die cut along line 28 to form the top of the pocket. FIG. 4 shows a similar view and depicts the portions of the bag plies and the pockets.

Figure 5:
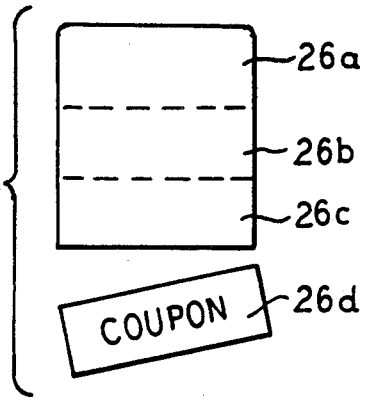
FIG. 5 is an elevational view of the couponing section showing removal of the coupon.

In FIG. 5 the coupon section 26 is shown removed and the bottom coupon is shown being detached.

Referring back to FIG. 1, the pocket can include or carry therein a napkin, such as 50, and eating utensil, such as a fork 52.

The plies of the front panel are glued together along the top, side and bottom sections of the front panel, and along the side, bottom and back panels. The bottom panel is folded and glued so as to form a folded construction.

Although the invention has been described with respect to preferred embodiments, it is not to be so limited as changes and modifications can be made which are within the full intended scope of the invention as defined by the appended claims.

I claim as my invention:

1. A paper bag for use at retail locations of the multi-ply-type with there being an inner ply and an outer ply which form a front panel, a back panel, a pair of side panels each joined to said front panel and said back panel, a bottom panel joined to each of the front, back and side panels, and an open top providing for access to the interior of the bag, and a primary compartment therein wherein:

the improvement comprises only the outer ply of the front panel being die cut along the first top edge which is spaced from and substantially parallel to the open top of the bag and perforated along second, third and fourth edges and the plies glued together along peripheral sections of the front panel so as to: (a) form a secondary pocket between the inner and outer plies; (b) permit insertion of relatively bulky items into the secondary pocket through the die cut top edge; (c) separate items in the secondary pocket from items in the primary compartment; and (d) form a coupon-like section in the outer ply of the front panel and secondary pocket, which is removable therefrom along the perforations.

2. A bag construction as in claim 1, wherein said coupon-like section includes a plurality of smaller removable sections separated by perforation lines.

* * * * *